US006808026B2

(12) United States Patent
Berger et al.

(10) Patent No.: US 6,808,026 B2
(45) Date of Patent: Oct. 26, 2004

(54) PNEUMATIC PERCUSSIVE TOOL WITH A SHORT WORKING DRIVE PISTON

(75) Inventors: Rudolf Berger, Grünwald (DE); Wolfgang Schmid, München (DE); Mirko Lysek, München (DE)

(73) Assignee: Wacker Construction Equipment AG, Munich (DE)

( * ) Notice: Subject to any disclaimer, the term of this patent is extended or adjusted under 35 U.S.C. 154(b) by 0 days.

(21) Appl. No.: 10/466,019

(22) PCT Filed: Jan. 30, 2002

(86) PCT No.: PCT/EP02/00963

§ 371 (c)(1),
(2), (4) Date: Jul. 30, 2003

(87) PCT Pub. No.: WO02/060652

PCT Pub. Date: Aug. 8, 2002

(65) Prior Publication Data

US 2004/0065454 A1 Apr. 8, 2004

(30) Foreign Application Priority Data

Jan. 30, 2001 (DE) ..... 101 03 996

(51) Int. Cl.[7] ..... B25D 11/04
(52) U.S. Cl. ..... 173/201; 173/109; 173/212
(58) Field of Search ..... 173/201, 109, 173/210, 212, 48, 200, 104, 118

(56) References Cited

U.S. PATENT DOCUMENTS 5,435,397 A * 7/1995 Demuth ..... 173/109
5,775,440 A * 7/1998 Shinma ..... 173/109
5,992,541 A * 11/1999 Frenzel et al. ..... 173/201
6,112,830 A * 9/2000 Ziegler et al. ..... 173/109
6,131,671 A * 10/2000 Shibata et al. ..... 173/48
6,237,700 B1 * 5/2001 Berger et al. ..... 173/201
6,523,622 B1 * 2/2003 Berger et al. ..... 173/212
6,568,484 B1 * 5/2003 Schmid et al. ..... 173/201

FOREIGN PATENT DOCUMENTS

| | | |
|---|---|---|
| DE | 197 28 729 A1 | 7/1997 |
| DE | 198 28 426 A1 | 6/1998 |
| DE | 198 43 642 A1 | 9/1998 |
| GB | 2 084 917 A | 10/1981 |

* cited by examiner

*Primary Examiner*—Scott A. Smith
(74) *Attorney, Agent, or Firm*—Boyle Fredrickson Newholm Stein & Gratz S.C.

(57) ABSTRACT

A pneumatic percussive tool for a paving breaker and/or a hammer drill, provided with a drive piston which is axially displaceable both backwards and forwards, comprising a guide sleeve and a piston bottom supporting the guide sleeve. A percussion piston can be displaced axially in the guide sleeve of the drive piston with the piston head thereof in percussive mode. During the transition from percussive to idling mode, the piston head slides out of the guide sleeve in such a way that the percussion piston is substantially maintained in the idling mode in an axially displaceable manner by means a stationary part of the percussion tool housing as opposed to being so maintained in the guide sleeve. The axial length of the drive piston can be reduced, whereby the mass of the drive piston and vibrations caused by the movement of the drive piston in the percussive and idling mode can also be reduced.

11 Claims, 3 Drawing Sheets

PNEUMATIC PERCUSSIVE TOOL WITH A SHORT WORKING DRIVE PISTON

The invention relates to a pneumatic percussive tool for a paving breaker and/or drill hammer according to the preamble of claim 1.

Amongst currently conventional percussive tool types for drill hammers or paving breakers, the one design which above all has proven to be successful is one in which a drive piston which is designed as a hollow piston is set to perform an oscillating axial movement by way of a crank drive. In the interior of the drive piston which is guided in the housing of the hammer, a solid percussion piston is moved which protrudes at the open end of the hollow drive piston and cyclically influences a chisel tool or an interconnected riveting die. For this purpose, a pneumatic spring is formed in a hollow space between the percussion piston and the drive piston and transmits the forced movement of the drive piston to the percussion piston and drives said percussion piston against the tool.

The percussive tool takes up relatively little installation space and can be produced cost-effectively. Furthermore, the percussion piston achieves a high impact speed. The reliable starting behaviour of the percussive tool from the idling mode is also particularly advantageous.

However, the considerable mass of the drive piston has proven to be disadvantageous, as it is moved in a reciprocating manner by the drive even during the idling mode, i.e. in a state in which the tool does not work any material. The relatively large oscillating masses make it more difficult to handle the hammer during idling.

DE 198 28 426 A1 discloses a pneumatic percussive tool, wherein the drive piston consists substantially of a piston base and a guide sleeve, in which the percussion piston can be moved in a reciprocating manner. The wall thickness of the guide sleeve is very low, whereby the weight of the drive piston is low and the oscillations occurring particularly during idling are small. The guide sleeve is provided with several air compensating slots, through which air is able to penetrate into the pneumatic spring between the percussion piston and the drive piston after each impact, in order to compensate for any loss of air possibly occurring during the impact operation. Furthermore, the guide sleeve is provided with idling orifices which allow a reliable transition from the percussion mode to the idling mode.

Even if, in the case of the pneumatic percussive tool according to DE 198 28 426 A1, the oscillations which occur particularly during idling could be reduced considerably, a further reduction in the mass of the drive piston and thus a corresponding reduction in the idling oscillations would be desired.

Therefore, it is the object of the invention to achieve a further reduction in the vibrations occurring during idling whilst retaining the positive features of the percussive tool.

In accordance with the invention, the object is achieved by means of a pneumatic percussive tool in accordance with claim 1. Advantageous embodiments of the invention are defined in the subordinate claims.

An inventive pneumatic percussive tool in accordance with the preamble of claim 1 is characterised by virtue of the fact that in the idling mode the percussion piston has slid completely out of a front end of the guide sleeve.

As a consequence, during normal percussion mode at least a part of the percussion piston can still be moved axially in the guide sleeve of the drive piston. With respect to the transition to the idling mode, the operator lifts the paving breaker and/or the drill hammer together with the tool from the stones which are to be worked, whereby the tool shaft slides to a certain extent out of the hammer. Accordingly, it is possible for the percussion piston likewise to move further forwards, in the direction of percussion, and slides out of the guide sleeve. Ideally, it moves completely out of the front end of the guide sleeve and is only held by means of the housing of the percussive tool. As a consequence, the hollow space between the percussion piston and the drive piston is opened, so that during further movement of the drive piston it is possible for air to penetrate into the hollow space surrounding the pneumatic spring and it is possible to prevent the percussion piston from being drawn back and to prevent any subsequent percussion operations. This results in a reliable idling behaviour.

If the operator then places the tool on to the stones, the tool shaft is displaced into the interior of the hammer, whereby the percussion piston is then also urged back into the guide sleeve of the drive piston. As a consequence, the hollow space between the drive piston and the percussion piston is closed, so that the effect of the pneumatic spring can be realised and the percussion mode can be recommended.

In the case of a particularly advantageous embodiment of the invention, the axial length of the guide sleeve of the drive piston is smaller than a maximum axial path of the percussion piston between its extreme positions. The axial length of the guide sleeve must be dimensioned in such a manner that although the percussion piston can be moved reliably in a reciprocating manner in the guide sleeve during the percussion mode, the percussion piston must be able to slide completely out of the guide sleeve during the idling mode. This results in a considerable reduction in the axial length of the drive piston and thus in a reduction in its mass and the idling oscillations which are associated therewith.

For the purpose of reliably holding the percussion piston during the idling mode, the percussive tool housing is advantageously provided with a device for receiving the piston head.

The receiving device allows the build-up of negative pressure for the purpose of holding the percussion piston, as will be explained hereinunder.

The movement of the percussion piston can be guided in various ways. It is particularly advantageous if the percussion piston is guided exclusively by the percussive tool housing, e.g. by its piston shaft, both during the idling mode and during the percussion mode. This can be utilised such that in the percussion mode, i.e. when the piston head of the percussion piston is located in the guide sleeve of the drive piston, the guide sleeve is guided by means of the percussion piston but not by the percussive tool housing. In this manner, it is possible to obviate undesired double fits which could occur if both the guide sleeve and also the percussion piston were each guided in the percussive tool housing. It is not necessary to guide the piston head of the percussion piston during the idling mode when the piston shaft is guided to a sufficient extent.

Accordingly, the above described device for receiving the piston head in the percussive tool housing can be dimensioned to be sufficiently large in order to avoid tolerance problems.

In the case of a particularly advantageous embodiment of the invention, the pneumatic spring can be supplied with and relieved of air during the idling mode by way of the front end of the guide sleeve, wherein the guide sleeve does not comprise any further idling orifices for the purpose of supplying the pneumatic spring with air during the idling mode. In contrast, in the case of the prior art, in particular in the case of the aforementioned DE 198 28 426 A1, it is necessary to provide corresponding idling orifices in the guide sleeve, in order to guarantee a reliable idling mode. However, since in accordance with the invention the percussion piston moves completely out of the guide sleeve and thus the end side of the guide sleeve is open, additional idling orifices are not required. The omission of idling orifices means that the costs of producing the drive piston fall and the susceptibility of cracking and fracture is reduced by reason of the omission of the notch effect which is otherwise produced by the idling orifices. Furthermore, it is possible to reduce tolerance problems not least owing to the shorter length of the drive piston.

It is particularly advantageous if the guide sleeve is provided with at least one air compensating slot which comprises an axial length which is longer than the axial length of the piston head of the percussion piston. As a consequence, any air loss in the pneumatic spring which has occurred during the generation of a percussive action can be compensated for whenever the piston head is located at the level of the air compensating slot. Then, for a brief moment the pneumatic spring downstream of the piston head is connected to the surrounding space upstream of the piston head. If the drive piston is already involved in its return movement at this point in time and thus exerts a suction effect upon the percussion piston, the negative pressure in the pneumatic spring will cause additional air to be drawn into the hollow space between the drive piston and the percussion piston. The air compensating slot allows the guide sleeve to be designed with a minimum wall thickness.

A further advantageous embodiment of the invention is that the receiving device which holds the piston head in the percussive tool housing in the idling mode is provided with a one-way valve which connects a front hollow space formed between the receiving device, the piston head and the piston shaft to the area surrounding the percussive tool, e.g. a crank space of the hammer. During the transition from the percussion mode to the idling mode and as the percussion piston slides accordingly out of the guide sleeve into the receiving device, excess air pressure which is provided in an air cushion and which is formed between the percussion piston and the receiving device can consequently be reduced via the one-way valve with respect to the area surrounding the percussive tool. Only if the percussion piston has travelled into the receiving device does the one-way valve close, whereby the attempt by the percussion piston to perform a return movement causes a suction effect to occur which holds the percussion piston in the receiving device. Only in the event of a correspondingly large force, which is produced e.g. when the tool is placed on to the stones which are to be worked, can the percussion piston be urged out of the receiving device and guided back into the guide sleeve.

It is not absolutely necessary for the percussion piston to consist of a piston head and a piston shaft which differs therefrom in geometric dimensions. On the contrary, in the case of a different embodiment of the invention, the piston head and the piston shaft of the percussion piston can also comprise a substantially identical diameter.

These and further advantages and features of the invention will be explained in detail hereinunder with reference to the accompanying Figures, in which FIG. 1 shows a schematic partial sectional view of an inventive pneumatic percussive tool with a percussion piston in the percussion position;

FIGS. 2 and 3 illustrate the same pneumatic percussive tool but with the moving pistons in different positions.

Figure 1:
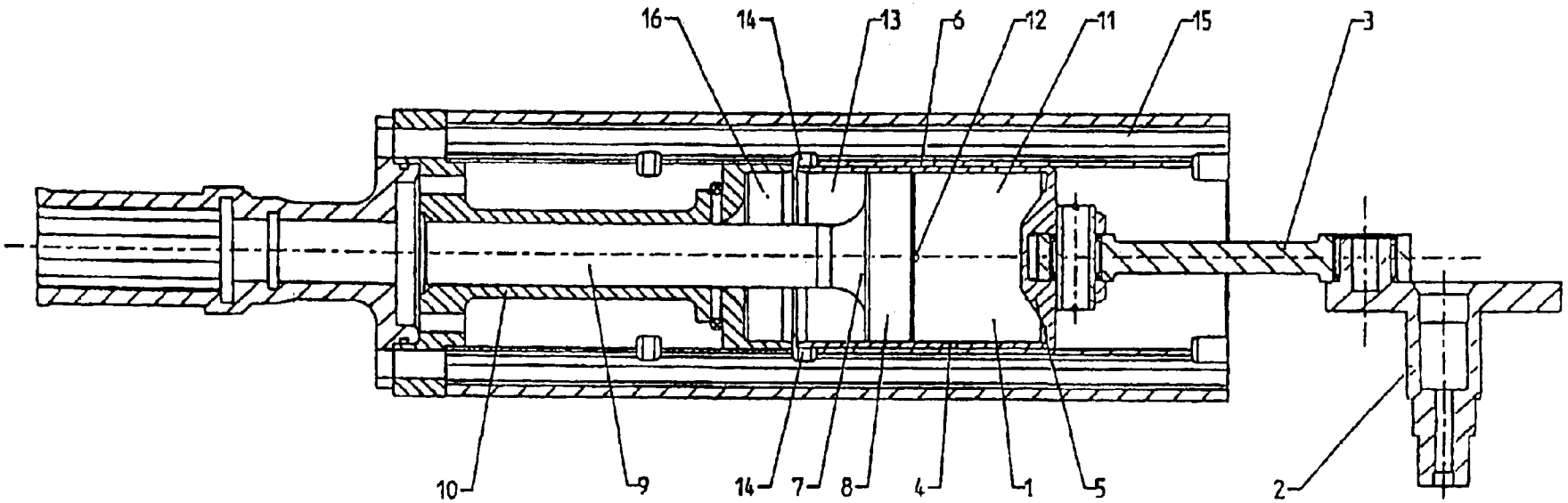
FIG. 1 shows a schematic sectional view of an inventive pneumatic percussive tool which is used e.g. in a paving breaker and/or drill hammer.

A drive piston 1 is set to perform an oscillating axial movement by way of a crank shaft 2, which is driven in a rotating manner, and a connecting rod 3. The drive piston 1 consists substantially of a guide sleeve 4 and a piston base 5 which closes off the guide sleeve 4 at a rear end side. The connecting rod 3 is connected in a known manner to the piston base 5 in such a manner as to be able to pivot.

The drive piston 1 can be moved axially with its guide sleeve 4 in a percussive tool tube 6. The percussive tool tube 6 forms part of a percussive tool housing.

FIG. 1 shows in the interior of the guide sleeve 4 a percussion piston 7 which consists substantially of a piston head 8 and a piston shaft 9, wherein the piston head 8 can be moved in the interior of the guide sleeve 4.

The piston shaft 9 is guided in a housing tube 10 which is associated with the percussive tool housing. With respect to the co-operation between the drive piston 1 and the percussion piston 7 this means that the percussion piston 7 is guided with its piston shaft 9 in the housing tube 10 and for its part guides the guide sleeve 4 of the drive piston 1 by way of the piston head 8.

Enclosed between the drive piston 1 and the piston head 8 of the percussion piston 7 is a hollow space 11, in which a pneumatic spring is formed, if the drive piston 1 is moved in a reciprocating manner. The oscillating movement of the drive piston 1 is transmitted by way of the pneumatic spring to the percussion piston 7 which completes the movement in a delayed manner and, with the front end of the piston shaft 9 remote from the drive piston 1, is able to strike in a known manner against a shaft [not illustrated] of a tool [also not illustrated] or against a riveting die [not illustrated]. FIG. 1 shows the percussion piston 7 in a percussion position, i.e. in the position in which it impinges upon the tool shaft or riveting die.

It is just possible in FIG. 1 to see a portion of an air compensating slot 12 which extends in the guide sleeve 4 with an axial length which is longer than the axial length of the piston head 8. The axial length of the air compensating slot 12 can be seen more clearly in FIG. 3, where the air compensating slot 12 is not covered by the piston head 8. As a consequence, it is possible for the pneumatic spring in the hollow space 11 to be connected for a short time via the air compensating slot 12 to a hollow space 13 upstream of the percussion piston 7. Since negative pressure has formed in the pneumatic spring at the time of impact or shortly before or after the impact, air is drawn from the hollow space 13 upstream of the percussion piston 7 and into the pneumatic spring, thus compensating for any loss of air caused at the time of the build-up of pressure in the pneumatic spring. For this purpose, air is able to flow out of the area surrounding the percussive tool via air ducts 15, which run in the percussive tool tube 6 or externally thereto, and openings 14 into the hollow space 13 upstream of the piston head 8 of the percussion piston 7.

Figure 2:
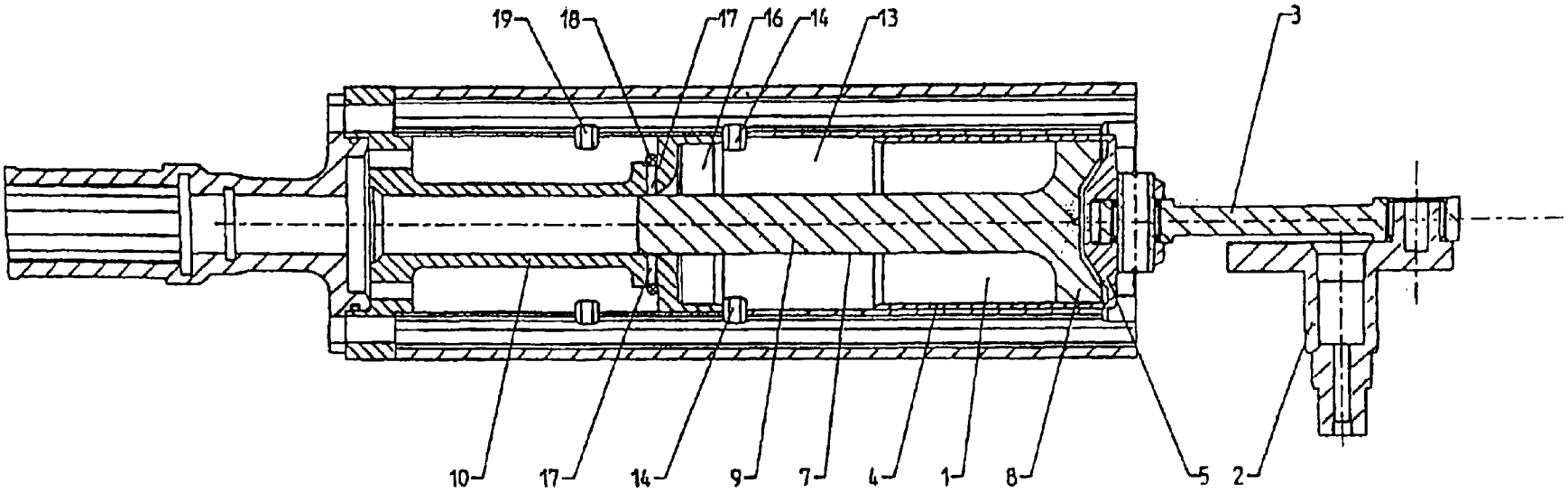
FIG. 2 shows a partial sectional view of the pneumatic percussive tool with the percussion piston in the rearmost position.

Whereas FIG. 1 shows the percussion piston 7 in a forward position, e.g. in the percussion position, FIG. 2 shows the pneumatic percussive tool with the percussion piston 7 in the rearmost position, in which the piston shaft 9 is still guided in the housing tube 10. The drive piston 1 is also located in its rearmost position by reason of the corresponding rotation of the crankshaft 2.

Figure 3:
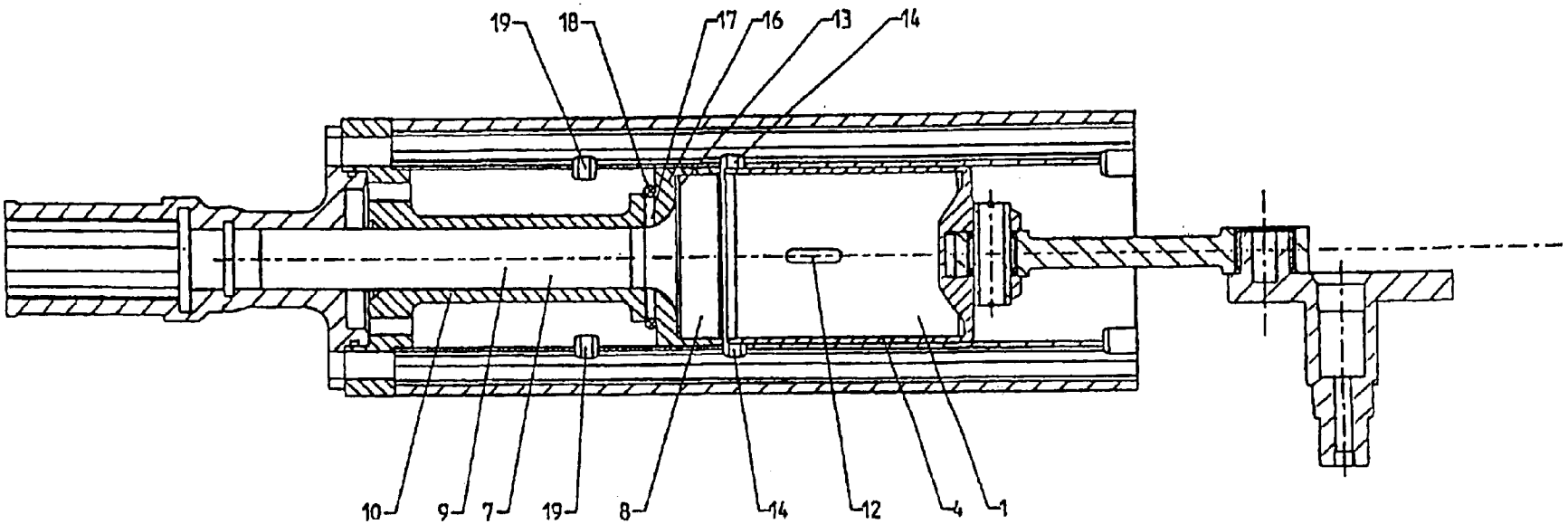
FIG. 3 shows a partial sectional view of the pneumatic percussive tool with the percussion piston in the idling position.

FIG. 3 shows the position of the percussion piston 7, if the pneumatic percussive tool is in the idling mode. The idling mode comes into effect if the operator lifts the tool from the stones being worked. Consequently the tool shaft, and optionally the riveting die, slides to a certain degree out of the housing of the hammer, whereby the percussion piston 7 is able to move to a position which still lies upstream of the percussion position shown in FIG. 1, namely to the idling position shown in FIG. 3.

Since the guide sleeve 4 of the drive piston 1 is much shorter than known guide sleeves, the percussion piston 7 slides with its piston head 8 out of the guide sleeve 4 and passes into a receiving device 16 which is associated with the percussive tool housing and in which said percussion piston is held in the idling position illustrated in FIG. 3. In turn, by reason of the continuous rotational movement of the crank shaft 2, the drive piston 1 continues its reciprocating movement. It is not absolutely necessary to provide the receiving device 16. In the case of a variation of the invention which is not illustrated, no receiving device 16 is provided, so that after moving out of the guide sleeve 4 the percussion piston 7 is guided exclusively on its shaft.

Since the piston head 8 has revealed the end side of the guide sleeve 4, it is possible for air to penetrate into the interior of the guide sleeve 4 via the openings 14 or—in the event of a forwards movement of the drive piston 1—also then to flow out, so that no pneumatic spring can be formed in the hollow space 11 of the guide sleeve 4.

In order then to start up the percussion mode, the operator places the tool on to the stones to be worked, whereby the tool shaft, and optionally the riveting die, is displaced into the interior of the housing of the hammer and urges the percussion piston 7 out of the receiving device 16, until it covers the end side of the guide sleeve 4 and is introduced into the guide sleeve 4. Since the hollow space 11 in the guide sleeve 4 is consequently closed off from the surrounding area, a pneumatic spring can then be built up very rapidly thus allowing the percussion mode to continue.

In order to be able to hold the percussion piston 7 with its piston head 8 in a reliable manner in the receiving device 16, the receiving device 16 is provided with a one-way valve which consists substantially of one or several orifices 17 and of a rubber ring 18. The orifices 17 connect the space 13 (front hollow space) upstream of the piston head 8 via openings 19 and the air ducts 15 to the surrounding area. The rubber ring 18 lies over the orifices 17. In the case of a build-up of pressure in the front hollow space 13, the rubber ring is lifted slightly, so that the air is able to issue out of the front hollow space 13 via the orifices 17 and the openings 19 to the surrounding area (in the case of a build-up of pressure by virtue of the forwards movement of the percussion piston 7). The percussion piston 7 is thus able to penetrate completely into the receiving device 16.

It is not necessary for the receiving device 16 to surround the piston head 8 closely or in an annular manner as depicted in the Figures. As already stated above, in the case of one embodiment of the invention the receiving device 16 can be omitted completely. As an alternative, the annular part of the receiving device 16 can be adequately spaced apart from the piston head 8, in order to obviate the risk of double fits. In so doing, it is necessary to take into consideration that the percussion piston 7 is already adequately guided with its piston shaft 9.

If the excess pressure in the front hollow space 13 has been reduced or the piston head 8 has penetrated completely into the receiving device 16, the rubber ring 18 then closes the orifices 17. If—as shown in FIG. 3—the periphery of the piston head 8 lies with a relatively high degree of fitting accuracy in the annular receiving device 16, and the front hollow space 13 practically no longer exists, a suction effect is produced on the percussion piston 7 and holds it in the receiving device 16 in the position shown in FIG. 3, even if the drive piston 1 continues its reciprocating movement and generates corresponding air flows upstream of the percussion piston 7. It is not possible to move the percussion piston 7 out of its idling position even by shaking the hammer. Only when the tool is placed on to the stones does the tool shaft or the riveting die coupled thereto displace the piston shaft 9 and thus the percussion piston 7 out of the idling position as shown in FIG. 3 and then to the percussion position as shown in FIG. 1, so that the percussion mode is recommended.

In the case of the above-described embodiment, a percussion piston 7 is used which comprises a piston head 8 with a larger diameter and comprises a piston shaft 9 with a smaller diameter. However, the basic principle of the invention, namely the movement of the percussion piston out of the guide sleeve of the drive piston and the associated short structural design of the drive piston can also be applied in differently formed percussion pistons. In particular, it is possible for the percussion piston to consist of only one piston head, or for the piston head and the piston shaft to comprise substantially the same diameter. However, the percussion piston 7 shown in the Figures having a piston head 8 with a larger diameter and a piston shaft 9 with a relatively smaller diameter comprises a shape which is advantageous in terms of impact theory.

It is also possible for the drive piston not to be produced in one piece—as in the case of the above described embodiment—but rather to be composed of various components. For example, in order to achieve a further reduction in the mass of the drive piston it can be expedient to produce the guide sleeve from steel and, in contrast, to produce the piston base from synthetic material or a different light material.

Furthermore, it is not always necessary for the piston head of the percussion piston to be held in an idling position in a receiving device. On the contrary, in the case of a different embodiment [not illustrated] of the invention the percussion piston is guided, in the idling mode, exclusively on the piston shaft after it has departed from the guide sleeve of the drive piston. The percussion piston is then guided e.g. by means of a component which corresponds to the housing tube of FIG. 1.

What is claimed is:

1. A pneumatic percussive tool for a paving breaker and/or drill hammer, comprising:

a drive piston which can be moved axially in a reciprocating manner in a percussive tool housing and has a substantially hollow-cylindrical guide sleeve and a piston base which supports the guide sleeve;

a percussion piston which can be moved axially in a reciprocating manner and which has a piston head and a piston shaft; and having a hollow space which can be formed between the drive piston and the percussion piston and which surrounds a pneumatic spring in a percussion mode; wherein in the percussion mode the percussion piston can be moved axially at least partially in the guide sleeve of the drive piston;

wherein the axial length of the guide sleeve is dimensioned in such a manner that in an idling mode the percussion piston has slid completely out of a front end of the guide sleeve.

2. A pneumatic percussive tool as claimed in claim 1, wherein, in the idling mode the percussion piston is not guided axially and held by means of the guide sleeve but rather is guided axially and held substantially by means of a stationary part of the percussive tool housing.

3. A pneumatic percussive tool as claimed in claim 1, wherein, in the percussion mode the percussion piston can be moved axially with its piston head at least partially in the guide sleeve of the drive piston.

4. A pneumatic percussive tool as claimed in claim 1, wherein the axial length of the guide sleeve is shorter than a maximum axial path of the percussion piston between its extreme positions.

5. A pneumatic percussive tool as claimed in claim 1, wherein, in the idling mode and/or in the percussion mode the percussion piston is guided in an axial manner exclusively on its piston shaft or on its piston shaft and on its piston head.

6. A pneumatic percussive tool as claimed in claim 1, wherein, in the idling mode the percussive tool housing is provided with a device for receiving the piston head of the percussion piston.

7. A pneumatic percussive tool as claimed in claim 1, wherein, in the idling mode the pneumatic spring can be supplied with and relieved of air via the front end of the guide sleeve, and the guide sleeve does not comprise any further idling orifices for the purpose of supplying the pneumatic spring with air in the idling mode.

8. A pneumatic percussive tool as claimed in claim 1, wherein the guide sleeve is provided with at least one air compensating slot which comprises an axial length which is longer than the axial length of the piston head of the percussion piston.

9. A pneumatic percussive tool as claimed in claim 1, wherein a front hollow space which is formed by the receiving device, the piston head and the piston shaft can be coupled to the surrounding area by way of a one-way valve.

10. A pneumatic percussive tool as claimed in claim 9, wherein the one-way valve comprises a radially prestressed, elastic ring which covers at least one orifice to the front hollow space.

11. Pneumatic percussive tool as claimed in claim 1, wherein the piston head and the piston shaft of the percussion piston comprise the same diameter.

* * * * *